US008123326B2

(12) United States Patent
Saettel et al.

(10) Patent No.: US 8,123,326 B2
(45) Date of Patent: Feb. 28, 2012

(54) CALIBRATION SYSTEM FOR MULTI-PRINTHEAD INK SYSTEMS

(75) Inventors: John J. Saettel, Trotwood, OH (US); Rodney G. Mader, Springfield, OH (US); Donald R. Allred, Springboro, OH (US)

(73) Assignee: Eastman Kodak Company, Rochester, NY (US)

( * ) Notice: Subject to any disclaimer, the term of this patent is extended or adjusted under 35 U.S.C. 154(b) by 216 days.

(21) Appl. No.: 12/568,713

(22) Filed: Sep. 29, 2009

(65) Prior Publication Data

US 2011/0074860 A1 Mar. 31, 2011

(51) Int. Cl.
*B41J 29/393* (2006.01)

(52) U.S. Cl. ..... 347/19

(58) Field of Classification Search ..... 347/5, 19; 101/183

See application file for complete search history.

(56) References Cited

U.S. PATENT DOCUMENTS

| | | | | |
|---|---|---|---|---|
| 3,803,628 | A | 4/1974 | Van Brimer et al. | |
| 4,794,453 | A | 12/1988 | Gnuechtel et al. | |
| 4,896,211 | A | 1/1990 | Hunt et al. | |
| 5,018,213 | A | 5/1991 | Sikes | |
| 6,068,362 | A | 5/2000 | Dunand et al. | |
| 6,317,147 | B1 * | 11/2001 | Tanaka | 347/116 |
| 7,515,267 | B2 * | 4/2009 | Ehbets et al. | 356/416 |
| 8,017,927 | B2 * | 9/2011 | Shakespeare et al. | 250/559.04 |

FOREIGN PATENT DOCUMENTS

EP 0 729 846 9/1996

OTHER PUBLICATIONS

J. J. Saettel, "Automated Time of Flight Speed Compensation", U.S. Appl. No. 12/568,733, (D-95644) filed Sep. 29, 2009.

J. J. Saettel et al., "Color to Color Registration Target", U.S. Appl. No. 12/568,750, (D-95645) filed Sep. 29, 2009.

J. J. Saettel et al., "Exposure Averaging", U.S. Appl. No. 12/568,762, (D-95646) filed Sep. 29, 2009.

* cited by examiner

*Primary Examiner* — An Do

(74) *Attorney, Agent, or Firm* — Peyton C. Watkins

(57) ABSTRACT

A method for calibrating a multi-printhead printing system, the method includes the steps of employing an encoder to track movement of a media through the printing system; providing a first printhead that prints a first image plane that includes a first test mark at a first defined location on the media as the media moves relative to the first printhead; providing a second printhead that prints a second image plane that includes a second test mark at a second defined location on the media as the media moves relative to the second printhead; employing a first image capture device that captures an image that includes both the first and second test marks; determining an error factor based on the placement of the second mark relative to the first mark in the captured image; and creating a frequency-shifted pulse train of the encoder in which the frequency shift is based on the error factor; wherein the first printhead prints the first image plane in response to output of the encoder and the second printhead prints the second image plane in response to the frequency-shifted pulse train of the encoder.

16 Claims, 5 Drawing Sheets

INITIAL

SHIFT DATA BY 3 JETS

FINAL

CALIBRATION SYSTEM FOR MULTI-PRINTHEAD INK SYSTEMS

CROSS REFERENCE TO RELATED APPLICATIONS

Reference is made to commonly assigned U.S. patent application Ser. No. 12/568,762 filed Sep. 29, 2009 by John Saettel, entitled "Exposure Averaging", commonly assigned U.S. patent application Ser. No. 12/568,750 filed Sep. 29, 2009 by John Saettel, entitled "Color to Color Registration Target", and commonly assigned U.S. patent application Ser. No. 12/568,733 filed Sep. 29, 2009 by John Saettel, entitled "Automated Time of Flight Speed Compensation", the disclosures of which are herein incorporated by reference.

FIELD OF THE INVENTION

The present invention generally relates to inkjet printing systems and, more particularly, to such inkjet systems that correct for printing deviations by using image capture devices to facilitate correction.

BACKGROUND OF THE INVENTION

Synchronizing printheads in order to correct for printing inaccuracies is a necessity in most printing systems since mechanical systems invariably include some sort of deviation from their desired target. For example, U.S. Pat. No. 6,068,362 ('362 patent) discloses a method for synchronizing printheads of a printing system. The printing system includes a plurality of printheads with optical sensors mounted "before" each printhead (upstream) at some predetermined distance. (see column 9, line 60 through column 10, line 4 of the '362 patent) A print media or a conveyor belt passes beneath the printheads in order to permit the printheads to print marks thereon. The optical sensors capture an image of the marks which are input into a synchronization circuit. The synchronization circuit determines whether any deviation from the desired target is present. If there is a deviation, the synchronization circuit modifies the line spacing of the printhead of interest in order to compensate for the inaccuracies. In this system, the adjusted line spacings are based on an output of an encoder attached to the paper drive motor. Such a system requires extremely high cost encoders to provide the resolution needed for the registration demands of a printer system. It also is subject to errors associated with slip or coupling between the motor and the motion of the paper through the print zone. This system is also very susceptible to errors produced by variations in motor speed such as wow and flutter.

It is noted that the above-described system discloses the printheads disposed spatially ahead of the particular printhead to which it is associated. In this configuration, there is an inherent time lag from image capture until the media passes beneath the printhead. This time lag in and of itself introduces another variable which is also subject to deviation from its desired target.

European Patent Application EP 0 729 846 A2 discloses a printed reference image compensation system. Similar to the '362 patent, there are a plurality of printheads for printing cue marks as the print media passes beneath each printhead. A camera "before" the second printhead captures an image of the cue mark printed by the first printhead. This permits the second printhead to adjust its printing if a deviation is detected as discerned from the captured image. More specifically, it states in column 7, lines 4-7, "the cue mark 18 must be sensed sufficiently in advance of the subsequent printhead 46 to allow the control signal from sensor 22 to be used to initiate the start of print by head 26 at the proper instant in time." Similar to the '362 patent, there is an inherent time lag between image capture and subsequent printing by the particular printhead which is undesirable as stated hereinabove.

Consequently, a need exists for a printing system which overcomes the above-described drawbacks.

SUMMARY OF THE INVENTION

The present invention is directed to overcoming one or more of the problems set forth above. Briefly summarized, according to one aspect of the invention, the invention resides in a method for calibrating a multi-printhead printing system, the method comprising the steps of (a) employing an encoder to track movement of a media through the printing system; (b) providing a first printhead that prints a first image plane that includes a first test mark at a first defined location on the media as the media moves relative to the first printhead; (c) providing a second printhead that prints a second image plane that includes a second test mark at a second defined location on the media as the media moves relative to the second printhead; (d) employing a first image capture device that captures an image that includes both the first and second test marks; (e) determining an error factor based on the placement of the second mark relative to the first mark in the captured image; and (f) creating a frequency-shifted pulse train of the encoder in which the frequency shift is based on the error factor; wherein the first printhead prints the first image plane in response to output of the encoder and the second printhead prints the second image plane in response to the frequency-shifted pulse train of the encoder.

These and other objects, features, and advantages of the present invention will become apparent to those skilled in the art upon a reading of the following detailed description when taken in conjunction with the drawings wherein there is shown and described an illustrative embodiment of the invention.

Advantageous Effect of the Invention

The present invention has the advantage of calibrating multi-printhead systems by modifying the encoder pulse train.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
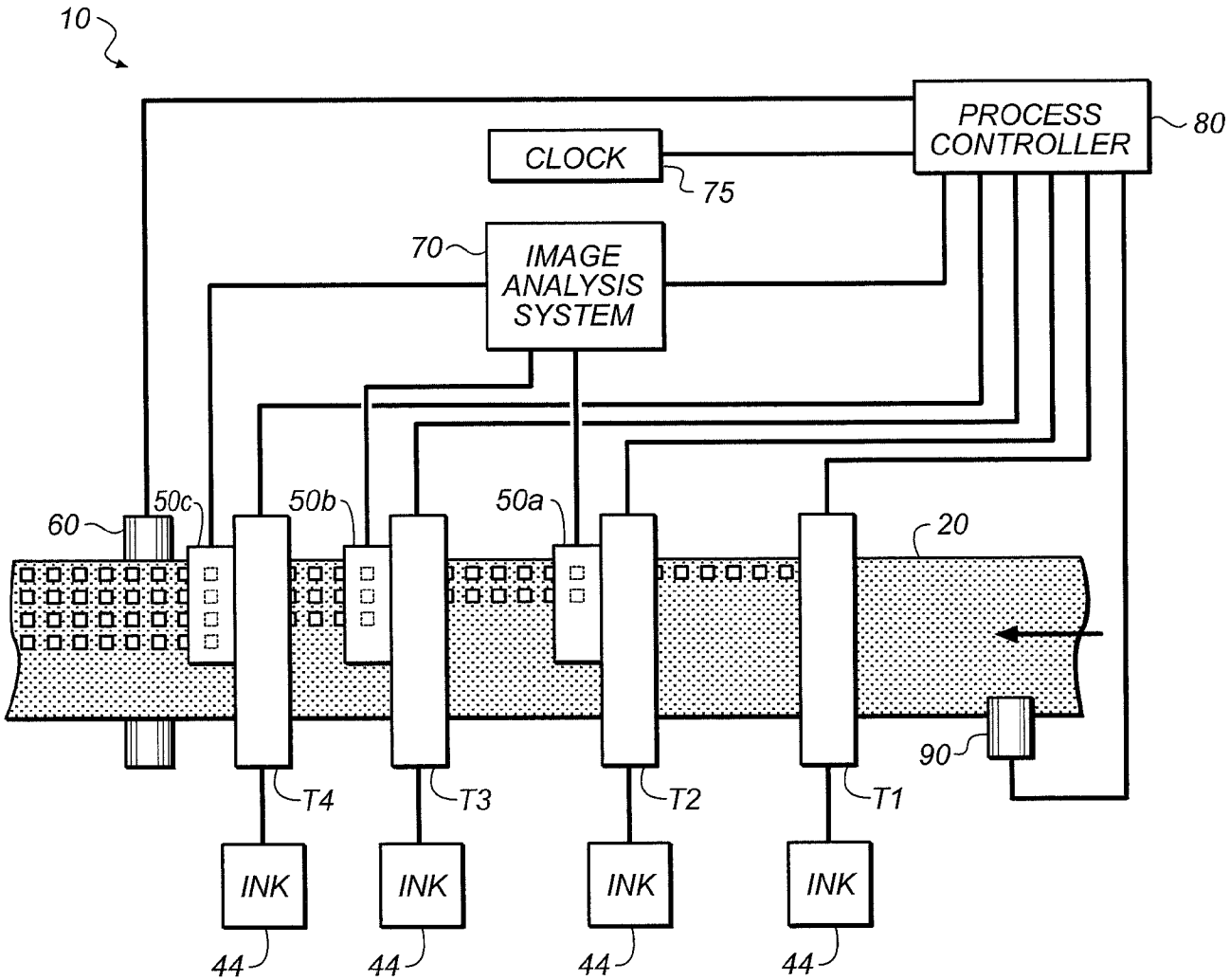
FIG. 1 is a block diagram of the calibration system of a multi-printhead printing system of the present invention.

Turning now to FIG. 1, there is shown a block diagram of the printing system 10 of the present invention. The printing system 10 includes a transport for transporting the print media 20 through various stages of the printing process. Four printheads (T1, T2, T3 and T4) span over the print media 20 each for dispensing ink of a different color on the print media 20 as the media 20 moves relative to the printheads T1-T4. Four ink holding receptacles 44, each of a different color, are respectively attached to each printhead T1-T4 for supplying ink thereto. Three image capture devices 50*a*, 50*b* and 50*c* are respectively disposed immediately downstream (i.e, in close proximity) of each of the last three printhead T2-T4 but not after the first printhead T1. Each image capture device 50*a*, 50*b* and 50*c* includes a digital camera and a light source both of which will be described in detail hereinbelow. Typically the light sources are strobe lights for producing short bright flashes of light to allow an image to be captured without motion blur. Typically the strobe lights consist of a plurality of Light Emitting Diodes (LED), commonly of red, green and blue LED's that are the color compliment of cyan, magenta, and yellow inks that are printed. Each camera 50*a*-50*c* captures an image of the media 20 after the printhead T2-T4 prints its respective ink on the media 20 for providing feedback as to whether calibration of the printing system is needed and, if so, the degree of calibration to be preformed, as will be described in detail hereinbelow. A drive motor (not shown) connected to a drive roller 60 exerts force on the print media for moving it through the printing system.

Figure 6:
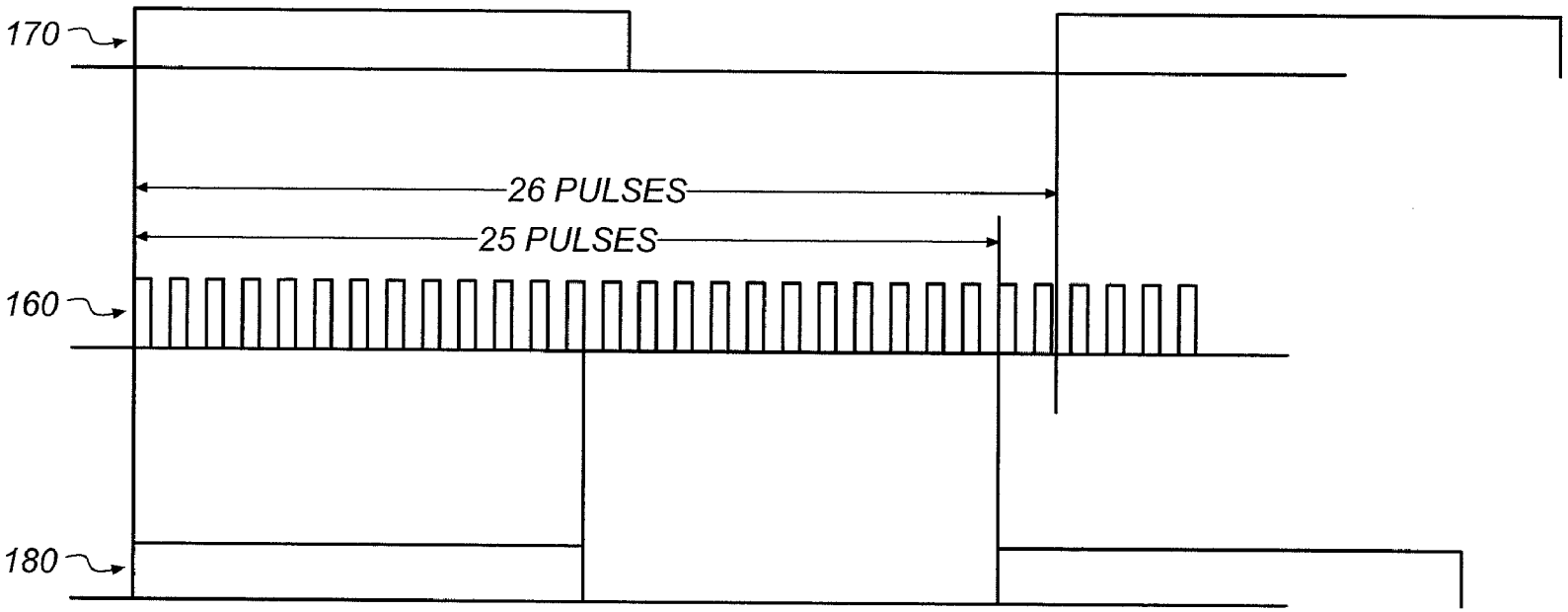
FIG. 6 is a diagram illustrating a frequency shifted pulse train.

The printing system 10 includes various components that perform process control and analysis. In this regard, an image system analyzer 70 receives the images captured by the image capture devices 50*a*-50*c* located downstream of each printhead T2-T4 to determine whether the ink marks printed by the respective printheads T1-T4 are aligned relative to each other as expected if aligned properly. In general, the image system analyzer 70 converts the images into bit maps, identifies each of the test marks, and determines their locations within the image, and calculates their alignment relative to each other in both the x and y directions, if any. Based on the result, the image system analyzer 70 sends a signal to the process controller 80. The printing system also includes a clock 75 that creates a clock pulse train 160 as shown in FIG. 6. The clock 75 communicates with the process controller 80, which uses the clock pulse train to create a frequency-shifted pulse train for each of the printheads T2, T3, and T4 from a base pulse train 170 created by encoder 90. It is noted that, in a four ink system, three images are captured with the initial ink mark not being imaged alone as there is no relative relationship by which the initial mark may be analyzed for correctness.

An encoder 90 is used to monitor the motion (in the direction of the arrow) of the print media 20 through the printing system 10. Typically the encoder 90 is in the form of a rotary encoder that creates a defined number of pulses per revolution. The rotary encoder is connected to a roller or wheel (not shown) that is rotated by the moving paper. The circumference of the wheel or roller, in combination with the defined number of pulses per revolution of the rotary encoder 90, determines the number of encoder pulses per centimeter or inch of paper travel. The output of the encoder 90, in the form of an encoder pulse train is used by the process controller 80 for controlling the placement of the print media 20 along the direction of print media travel. Typically the spacing of pixels in the in-track direction (along the direction of paper motion) corresponds to N times the spacing between encoder pulses, where N is a small (<10) integer. To properly print a multicolor document, the print data sent to each printhead T2-T4 downstream of the first printhead T1 must be delayed by increasing amounts relative to the data of first printhead. These delays are normally defined in terms of a delay count or the number of the encoder pulses that correspond to the spacing along the paper path of the printheads T2-T4 from the first printhead T1. For example, if the second printhead T2 is located 8.5 inches downstream of the first printhead T1 and the encoder 90 produces 600 pulses per inch, the print data to the second printhead T2 would be delayed by 5100 pulses relative to the data to the first printhead T1.

During the printing process however, it is possible for the effective spacing between the printheads T1-T4 to vary, due, for instance, to stretching of the print media 20, resulting in misregistration of the images from the various printheads T1-T4. If by means of the image capture device and the image processing unit such a registration error is detected, the process controller 80 can modify the operation of the printing system 10 to correct for this misregistration, as will be described later.

While the description above describes the printer in terms of four printheads each printing a separate color, the invention is not limited to printing systems having exactly four printheads. The invention is also not limited to registering multicolor images, but rather can also be employed to register the print from different printheads that are of the same color. For example two printheads may be used to print separate swaths of the printed documents, which may be registered using this invention. The term image plane is used herein as that portion of the print that is printed by a particular printhead. Each printhead prints a single image plane.

Figure 2:
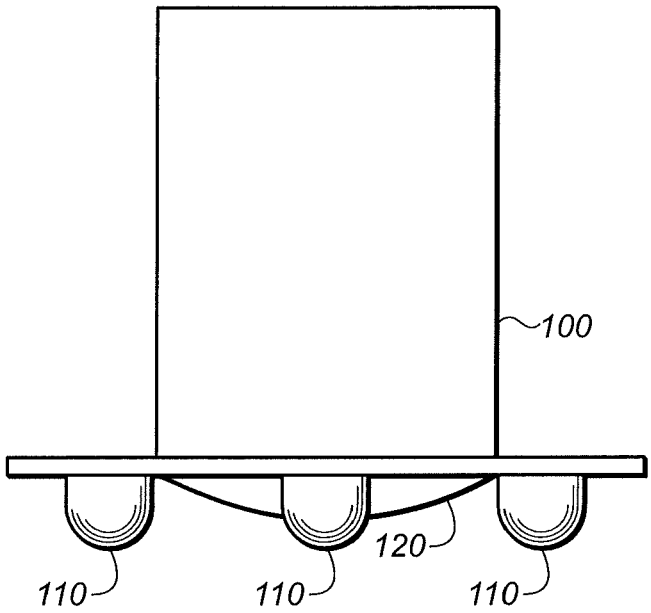
FIG. 2 is a side view of an image capture device of the present invention used in FIG. 1.
Figure 3:
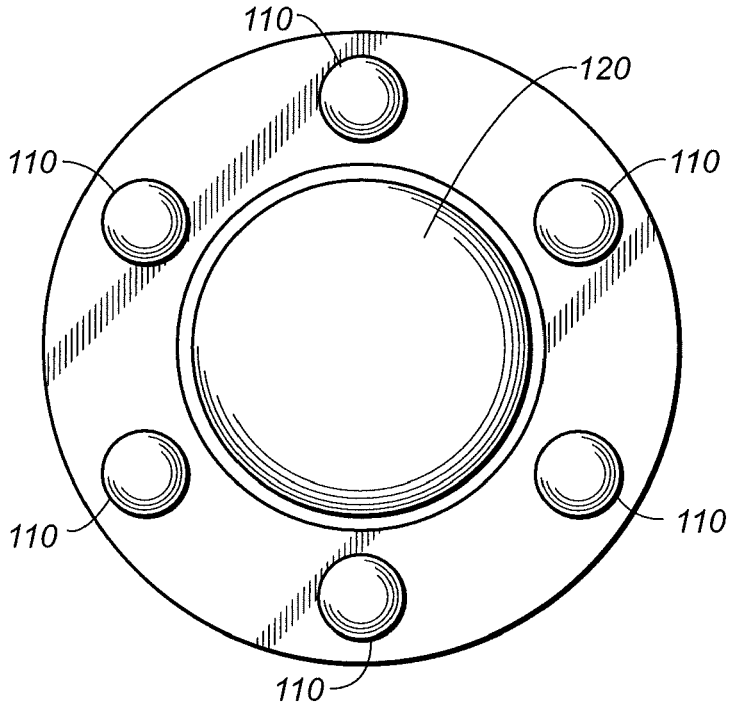
FIG. 3 is a bottom view of FIG. 2.

As mentioned above, three image capture devices 50*a*, 50*b* and 50*c* are respectively disposed immediately downstream (i.e, in close proximity) of each of the last three printhead T2-T4 but not after the first printhead T1. Referring to FIGS. 2 and 3, there is shown an exemplary image capture device 50 that is appropriate for use as the image capture devices 50*a*-50*c* of the present invention. The image capture device 50 includes a digital camera 100 having a plurality of light receptacles with each holding a strobe light 110. A lens 120 is disposed in the optical path of the digital camera 100 for providing optical focus to the digital camera 100. Various digital cameras 100 can be employed provided they have sufficient optical resolution and light sensitivity to capture images of the test marks. One such useful camera is the IMP-VGA210-L from Imperx. This is a black and white camera with a 640×480 pixel resolution. It is able to output images at a rate of 200 frames per second through a CameraLink™ interface to an image processing system. An infinite conjugate micro-video lens from Edmund Optics, #56776, with a 25 mm focal length and a 1:1 magnification is an effective lens for use with this camera. In one embodiment, the strobe lights 110 are light emitting diodes, two LED's each of red, green and blue, arranged circular around the lens of the camera. Light emitting diodes from Luxeon, such as LXHL-PH09, LXHL-PM09, and LXHL-PRO09, are examples of usable LED's.

The image capture devices 50*a*-50*c* may be mounted on a carriage downstream of each printhead so that the image capture devices are adjustable in position in a cross-track direction. Alternatively, the image capture devices 50*a*-50*c* may be mounted directly to downstream side of the printheads T2-T4 respectively so that they can capture the image of the test marks printed by the printhead to which they are mounted and the first printhead.

Figure 4:
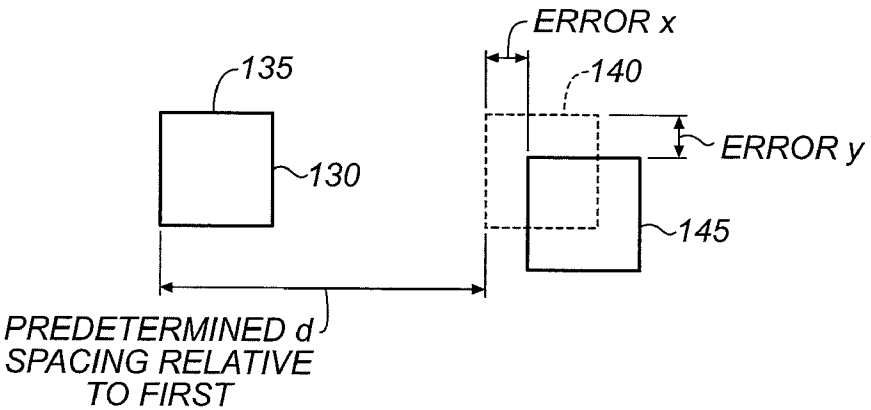
FIG. 4 is a diagram illustrating misregistration of the printheads.

Referring to FIG. 4, exemplary test marks are shown. Test mark 130 is the first test mark printed at a first defined location 135 by a first printhead T1. By design of the test pattern, a second printhead T2 is to print a second test mark at a second defined location 140. By design, the second defined location 140 for printing the second test mark is offset by a predetermined amount in one or both of the in-track (Y axis) and the cross-track (X axis) directions from the first defined location 135. FIG. 4 not only shows the expected locations of the first and second test marks 135 and 140 but also shows the locations of the test marks 130 and 145 as captured by the camera. In this example, the first test mark 130 and the second test mark 145 are misaligned by error x and error y. The test mark location 140 is the expected location of the second test mark 145 and the actual second test mark 145 is misaligned both in the x and y directions. The image analysis system 70 is used to analyze the image captured by the image capture device 50*a*-50*c*. This system can identify the test marks. It then can determine the location of each of the test marks 130 and 145 within the frame of the captured image. The position of the second test mark 145 relative to the position of the first test mark 130 is then calculated. The calculated relative position between the printed test marks 130 and 145 is then compared to the intended relative positions 135 and 140 of the test marks to determine an error factor. The error factor can include both in-track and cross-track terms. The error factor determined in this manner is transferred from the image analysis system 70 to the process controller 80.

Still referring to FIG. 4, it is noted that the second test mark 145 is part of the second image plane that is printed by the second printhead T2 is shifted to the right of its intended location. To correct for this cross track error in some embodiments of the invention, the process controller 80 can send commands to a cross-track actuator that physically moves the second printhead T2 by the appropriate amount to eliminate the detected cross-track error.

Figure 5A:
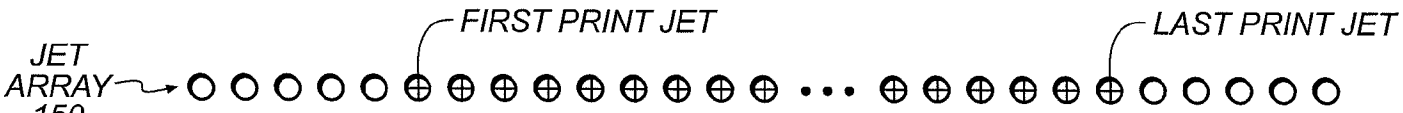
FIG. 5A is an illustration of a printhead array used in FIG. 1.
Figure 5B:
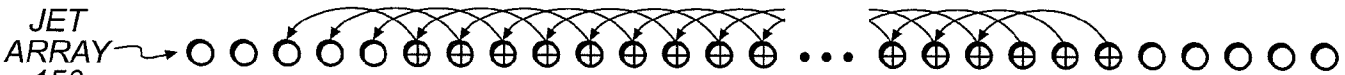
FIG. 5B is an illustration of the printhead array illustrating data shifting.
Figure 5C:
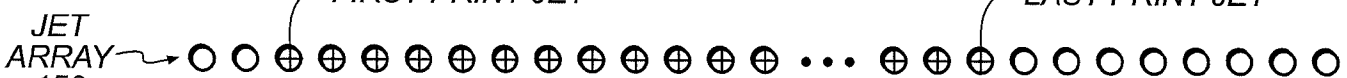
FIG. 5C is the final printing configuration of the printhead in FIG. 1 after data shifting.

In another embodiment, the printhead T2 is not physically moved but rather data to be printed by the second printhead T2 is moved laterally. This is possible because the second printhead T2 has more jets than are used for printing. FIG. 5A shows a jet array 150. The jets 150 normally designated for printing as indicated, with the first print jet being the sixth jet from the left. The last print jet is the sixth jet from the right. FIG. 5B illustrates that the print data normally associated with a jet when it is shifted three jets to the left. As a result in FIG. 5C, the first print jet is now the third jet from the left and the last print jet is now the ninth jet from the right.

If an in-track error is identified, it is possible to bring the image planes into registration by changing the delay count by which data to a second or subsequent printhead T2 is delayed relative to the first printhead T1. While this method can bring the printed image planes into registration, the implementation of a change in the delay count can produce a visible print artifact. For example, a change in the delay count could result in some lines of print data being omitted or it could lead to a visible gap in the printhead image. The present invention brings the image planes into correct registration by creating multiple versions of the encoder pulse train, one for each of the printheads. In other words, a frequency-shifted pulse train is created for every printhead T2-T4 which needs correction other than the first printhead T1. The encoder pulse train for a specific printhead is then used to modify the encoder pulse used to control the printing of one of the printheads by advancing or delaying in time the pulses in the pulse train. This also can produce similar artifacts when the correction step is implemented. To avoid these artifacts, the present invention corrects the registration by means of gradually advancing or delaying the pulses in the pulse train until the desired amount of advancement or delay is obtained. A convenient means to gradually advance or delay the phase of the pulse train is to introduce a slight frequency shift to the pulse train. An increase in the pulse frequency will serve to gradually advance each pulse in the pulse train and a decrease in frequency will gradually delay each pulse in the pulse train. To correct for any in-track errors, the frequency of a pulse train of a particular printhead is adjusted. In other words, calibration of the frequency of the data output to the particular printhead is adjusted to compensate for these errors.

If the detected in-track error factor as shown in FIG. 4 is δY, and the error is to be corrected gradually over a correction distance $Y_{cor}$, the correction factor CF is given by $$CF = 1 + \frac{\delta Y}{Y_{cor}}$$

It is noted that motion of the media through the distance Ycor takes place over a period of time; therefore, the corrections are done gradually and the final correction appears at the end of the time period. The error factor δY is negative if the second test mark 145 lies below the intended location 140 as is shown in FIG. 4. Conversely the error factor is positive if the second test mark 145 lies above the intended location 140. In a preferred embodiment, the correction distance Ycor is equal to the distance the paper moves between successive measurements of the registration error.

Referring to FIG. 6, there is shown an example of a frequency shifted pulse train for correcting for in-track error. The center pulse train 160 is the system clock which maintains a constant clocking so that other components of the system can have a timing mechanism. The top pulse train 170 is the pulse train from the encoder 90. The period or time between pulses, $P_{encoder}$, can be measured by counting the number of system clock pulses 160 (either the number of rising or falling edges) between pulses. In this figure, the period is measured from one rising edge of the encoder pulse train 170 to the next to yield a count of 26 clock pulses of the system clock pulse train 160. It is also possible to measure from one falling edge to another. If the encoder pulses 170 have a 50% duty cycle, where pulse high time equals the pulse low time, the number of system clock pulses between rising and falling edges of the pulses gives a measurement of half the pulse period. (In practice it is desirable to average together several measurements of the period to reduce the counting statistic noise.) A new frequency-shifted pulse train 180 is then created with a new period, $P_{shift}$, that is equal to the measured period times a correction factor that is based on the determined in-track error factor.

$$P_{shift}=P_{encoder}*CF$$

For the example in FIG. 6, a correction factor CF of 0.96 times the measured period, $P_{encoder}$, of 26 system clock pulses yielded a period, $P_{shift}$, for the frequency-shifted pulse train 180 of 25 system clock pulses. The frequency-shifted pulse train 180 can then be created by forming pulses that are separated by 25 system clock pulses. This change will decrease slightly the spacing of the pixels for the second printhead so that the second image plane, printed by the second printhead will gradually shift up toward alignment with the first image plane. If no error is detected the correction factor CF will equal 1 so the period, $P_{shift}$ of the frequency-shifted pulse train is equal to the period of the encoder $P_{encoder}$. To reduce errors produced by noise or jitter in the measurement of the encoder pulse period $P_{encoder}$, the value of $P_{encoder}$ in equation 2 can be an averaged value of several measurements of the period.

The method of the present invention corrects the spacing of the placement of the second image plane relative to the first image plane by utilizing a clock, typically a precise crystal controlled clock as the master reference for producing the frequency-shifted pulse train. Such clocks are very stable and have easily detected pulses with minimal fluctuation in time from pulse to pulse. This enables the timing of the pulses in the frequency shifted pulse train from pulse to pulse to be quite stable so that the spacing of lines printed by the second printhead is very consistent. This is in contrast to the line spacing adjustment method of the '362 patent that was based solely on pulses produced by the position detection encoder. As such encoders typically produce significant jitter in timing from pulse to pulse, the line spacings produced by that system would include significant jitter as well.

In another embodiment of the present invention, the process controller can identify trends in the number of clock pulses between encoder pulses. In this manner, it can determine acceleration/deceleration rates from changes in the number of clock pulses per encoder pulse, and can anticipate what the velocity will be a short time into the future. Using this information, it can refine the frequency-shifted pulse train to more accurately correspond with the paper motion to yield more accurate print placement.

The invention has been described in detail with particular reference to certain preferred embodiments thereof, but it will be understood that variations and modifications can be effected within the spirit and scope of the invention.

The invention has been described in detail with particular reference to certain preferred embodiments thereof, but it will be understood that variations and modifications can be effected within the spirit and scope of the invention.

PARTS LIST

| | |
|---|---|
| T1-T4 | printheads |
| 10 | printing system |
| 20 | print media |
| 44 | holding receptacles |
| 50a-50c | image capture devices |
| 60 | drive roller |
| 70 | image system analyzer |
| 75 | clock |
| 80 | process controller |
| 90 | encoder |
| 100 | digital camera |
| 110 | strobe light |
| 120 | lens |
| 130 | first test mark |
| 135 | first defined location |
| 140 | second defined location |
| 145 | second test mark |
| 150 | jet array |
| 160 | system clock pulse train |
| 170 | encoder pulse train |
| 180 | frequency-shifted pulse train |

The invention claimed is:

1. A method for calibrating a multi-printhead printing system, the method comprising the steps of:

(a) employing an encoder to track movement of a media through the printing system;

(b) providing a first printhead that prints a first image plane that includes a first test mark at a first defined location on the media as the media moves relative to the first printhead;

(c) providing a second printhead that prints a second image plane that includes a second test mark at a second defined location on the media as the media moves relative to the second printhead;

(d) employing a first image capture device that captures an image that includes both the first and second test marks;

(e) determining an error factor based on the placement of the second mark relative to the first mark in the captured image;

(f) using a clock to measure a frequency in a pulse train of the encoder; and (g) using the clock to create a frequency-shifted pulse train of the encoder in which the frequency shift is based on the error factor; wherein the first printhead prints the first image plane in response to output of the encoder and the second printhead prints the second image plane in response to the frequency-shifted pulse train of the encoder.

2. The method as in claim 1, wherein the first and second marks have a predetermined offset in one or both directions.

3. The method as in claim 1, wherein each printhead includes an array of nozzles from which ink is ejected and print data for the second printhead can be shifted laterally to be printed by a different subsection of the array within the second printhead in response to the error factor.

4. The method as in claim 3, wherein the print data, which is to be printed by the printhead, comprises bit map information that has been retrieved from a buffer memory.

5. The method as in claim 1, wherein the first image plane includes one or more first test marks and additional data other than test mark information.

6. The method as in claim 1, wherein the first printhead prints a first color and the second printhead prints a second color.

7. The method as in claim 1 further comprising the steps of providing at least a third printhead that prints at least a third image plane that includes at least a third test mark at least a third defined location.

8. The method as in claim 7 further comprising the step of employing the first image capture device or a second different image capture device that captures an image of the first, second and at least the third test marks.

9. The method as in claim 8 further comprising the step of determining at least a second error factor based on the placement of the at least third test mark relative to the first test mark in the captured image.

10. The method as in claim 9 further comprising the step of creating at least a second frequency-shifted pulse train of the encoder in which the at least second frequency shift is based on the at least second error factor; wherein the first printhead prints the first image plane in response to output of the encoder and the at least third printhead prints the third image plane in response to the at least second frequency-shifted pulse train of the encoder.

11. The method as in claim 9, wherein each printhead includes an array of nozzles from which ink is ejected and print data for the at least third printhead can be shifted laterally to be printed by a different subsection of the array within the third printhead in response to the at least second error factor.

12. The method as in claim 1, wherein the first and second printheads print in the same color.

13. The method as in claim 1, wherein the step of creating the frequency shifted pulse train comprises determining the number of pulses N from a system clock between encoder pulses and then creating the frequency shifted pulse train in which consecutive pulses are N times a correction factor of system clock pulses apart in which the correction factor is based on the error factor.

14. The method as in claim 10 wherein the step of creating the at least second frequency shifted pulse train comprises determining the number of pulses N from a system clock between encoder pulses and then creating the at least second frequency shifted pulse train in which consecutive pulses are N times at least a second correction factor of system clock pulses apart in which at least the second correction factor is based on at least the second error factor.

15. The method as in claim 1, wherein the image capture device is located downstream of the second printhead.

16. The method as in claim 15, wherein the image capture device is adjustable in position in a cross-track direction.

* * * * *